United States Patent [19]

Johnson

[11] Patent Number: 4,692,385

[45] Date of Patent: Sep. 8, 1987

[54] TRIPLEX ARTICLE

[75] Inventor: Philip C. Johnson, Lexington, Mass.

[73] Assignee: Materials Development Corporation, Medford, Mass.

[21] Appl. No.: 851,086

[22] Filed: Apr. 14, 1986

[51] Int. Cl.[4] ..... B22D 25/00

[52] U.S. Cl. ..... 428/469; 428/472; 428/698; 428/699

[58] Field of Search ..... 428/469, 472, 698, 699

[56] References Cited

U.S. PATENT DOCUMENTS 3,471,342 10/1969 Wood ..... 428/610
3,539,192 11/1970 Prasse ..... 428/610
3,765,954 10/1973 Tokuda et al. ..... 428/610
4,411,960 10/1983 Mizuhara ..... 428/698 X
4,485,148 11/1984 Rashid et al. ..... 428/610

*Primary Examiner*—Nancy A. Swisher
*Attorney, Agent, or Firm*—Finnegan, Henderson, Farrabow, Garrett & Dunner

[57] ABSTRACT

A coated article and method for manufacturing the same wherein an alloy substrate of iron, nickel, cobalt, or titanium base has a diffusion layer formed thereon of an intermetallic boride of the substrate alloy. A coating is subsequently deposited on the diffusion layer, which coating is a refractory, ceramic or intermetallic compound having desired wear and/or corrosion resistant properties superior to those of the substrate.

27 Claims, No Drawings

TRIPLEX ARTICLE

BACKGROUND OF THE INVENTION

It is well known for various end use applications to provide articles that are coated with a material that is characterized by wear or corrosion resistance superior to that of the body or substrate of the article. For this purpose, it is known to provide an alloy article, such as an iron, nickel, cobalt and titanium-base alloy, which is formed by various conventional operations, such as rolling, forging and extrusion, to a final-product configuration. Thereafter, the desired wear or corrosion-resistant coating is deposited. The coating is selected depending upon the wear or corrosive media to which the article is to be subjected during use. Typically, for this purpose, the coating is of a material that is harder and less formable than that of the article, and consequently if the entire article were made of the coating material or if coated prior to forming it would be difficult or impossible to form the article to the desired configuration. In addition, the resistant coatings are generally of a material more expensive than that of the remainder of the article. Typical coatings which are applied to these alloy substrates for wear and/or corrosion resistance are refractories, ceramics and intermetallic compounds.

With iron, nickel and cobalt base alloys, the deposited, resistant coatings are susceptable to separation from the substrate by spalling as a consequence of differential thermal expansion between the coating and the substrate. Wear and corrosion resistant coating materials typically have a coefficient of thermal expansion considerably lower than that of the alloy substrate. Thermal spalling therefore may occur during temperature changes, because the differential thermal expansion between the substrate and the coating creates stresses at the coating-substrate interface which may exceed the interfacial bond strength. In addition, spalling may occur due to mechanical stress superimposed on the coating during commercial use, e.g. impact loads. This propensity for spalling of these coatings is exacerbated by the inability of these coatings to relieve these stresses by plastic flow because of their typical low-ductility and high-hardness.

The coatings, which generally must be applied in accordance with conventional practices at elevated temperature, may also spall on cooling to ambient temperature after elevated-temperature application. Consequently, because of the spall problem many of the desirable wear and/or corrosion-resistant coatings are limited in their use to specific alloy substrates of limited commercial utility and when used may be restricted to undesirably thin coating thicknesses insufficent for prolonged use of the article in commercial applications.

With titanium-base alloys and articles made therefrom, the desired, well known strength-to-weight ratio of titanium is advantageous in various commercial applications. Titanium alloys, however, perform relatively poorly in applications requiring resistance to wear, erosion and abrasion. Consequently, wear, abrasion and erosion-resistant coatings for use with titanium-base alloys are commercially significant.

A desirable coating for this purpose is titanium diboride ($TiB_2$). This compound is extremely hard and exhibits outstanding wear properties. Very thin layers of intermetallic compounds of titanium and boron, including titanium diboride, can be formed on titanium alloy surfaces by subjecting the titanium alloy to activated boron-diffusion processing at elevated temperatures. Unfortunately, the temperatures and times required to form these boride diffusion layers to depths or thicknesses of commercial significance are so high that degradation of the properties of the titanium alloy substrate results. Titanium diboride deposited or added-on coatings, however, as opposed to diffusion layers, may be produced on titanium alloy substrates by the use of chemical vapor deposition (CVD) in commercially sufficient thicknesses and at temperatures below which the titanium alloy substrate is degradated. Specifically, in accordance with conventional practice these coatings may be provided by hydrogen reduction of titanium tetrachloride and boron trichloride to form titanium diboride. Hydrogen chloride gas, however, is formed as a by-product of this reaction. Unfortunately, halogens and halogen-containing compounds, including chlorine and hydrogen chloride gas, corrode and otherwise degradate the titanium alloy surface so that the desired high-quality CVD coatings cannot be produced. Therefore, titanium base alloy articles having a titanimum diboride abrasion or wear resistant coating of adequate thickness for the desired commercial applications are not available.

SUMMARY OF THE INVENTION

It is accordingly an object of the present invention to provide an alloy article of iron, nickel, cobalt or titanium base alloys wherein a coating may be provided having a desired wear and/or corrosion resistant property, which coating may be a refractory, ceramic or intermetallic compound.

A more specific object of the invention is to provide an article of this character and a method for producing the same wherein the wear and/or corrosion resistant coating is not subject to spalling from mechanical stresses or thermal cycling.

Another specific object of the invention is to provide a titanium-base alloy article wherein a desired wear and/or corrosion resistant coating of titanium diboride may be provided by chemical vapor deposition without causing degradation of the properties of the titanium-base alloy substrate.

Broadly, in accordance with the invention the coated article thereof comprises an alloy substrate with the alloy being an iron, nickel, cobalt or titanium-base alloy with a diffusion layer formed thereon of an intermetallic boride of the substrate alloy. Subsequently, a coating is provided on this diffusion layer of a material having desired wear and/or corrosion-resistant properties superior to those of the alloy substrate; the coating may be a refractory, ceramic or an intermetallic compound.

With cobalt, nickel, and iron-based alloys, these coatings generally possess a coefficient of thermal expansion lower than the substrate. Thermally induced interfacial stresses therefore occur during cooling from the deposition temperature, which may cause spall failure as discussed above. In accordance with the present invention, the diffusion layer of intermetallic boride provides a surface with a thermal expansion coefficient more closely matched to the subsequently deposited coating, than would be the uncoated alloy surface, thereby preventing spalling on cooling. In addition, the diffused boride layer is relatively high in hardness and therefore provides excellent mechanical support for the subsequently applied coating. The coating has a coefficient of thermal expansion that is closer to that of the diffusion layer than that of the substrate. More specifically, the coating may have a coefficient of thermal expansion within +/−30% of that of the diffusion layer and more preferred +/−15% of that of the diffusion layer. The specific coating material may be titanium diboride ($TiB_2$); aluminum oxide ($Al_2O_3$); titanium carbide (TiC); chromium carbide ($Cr_3C_2$); vanadium carbide (VC); and titanium nitride (TiN).

In producing articles in accordance with the invention having a titanium-base alloy substrate, the diffusion layer comprises an intermetallic titanium boride compound and the coating is deposited on the diffusion layer by chemical vapor deposition wherein a halogen compound is formed. This halogen compound is detrimental from the standpoint of degrading the properties of the titanium-based substrate; however, the diffusion layer of an intermetallic titanium boride compound protects the titanium-base alloy substrate by shielding it from the adverse affects of the halogen compound. For this purpose the diffusion layer should be continuous over the substrate surface. The coating is preferably thicker than the diffusion layer but is at least as thick as the diffusion layer. The coating and the diffusion layer are formed at temperatures at which the properties of the substrate are not substantially affected. More specifically, in accordance with the invention it has been determined that a diffusion layer of an intermetallic titanium boride compound may be formed in a titanium substrate at sufficiently short times and sufficiently low temperatures to thicknesses insufficient for commercial, resistant applications but sufficient to act as a shield or barrier preventing adverse affects from halogens, specifically hydrogen chloride gas, without temperature degradation of the properties of the titanium substrate. Consequently, a resistant coating having a greater thickness suitable for typical commercial applications may be deposited by chemical vapor deposition over the diffusion layer without the hydrogen chloride gas produced incident to this coating operation adversely affecting the titanium substrate. Therefore, for the first time resistant coatings of for example titanium diboride in thicknesses sufficient for typical end-use applications may be produced in a titanium substrate without the substrate being adversely affected by either elevated temperatures or halogen compounds, such as hydrogen chloride gas.

DETAILED DESCRIPTION OF THE PREFERRED EMBODIMENT

In accordance with the practice of the invention, the substrate of iron, nickel, cobalt or titanium-base alloy is formed by conventional practice to the shape of the desired article. Boron is then diffused into the surface of the article to form the desired diffusion layer of an intermetallic boride of the substrate alloy. With an iron base alloy substrate the boride may be $Fe_2B$; with a nickel based alloy the boride may be $Ni_2B$; with cobalt based alloy the boride may be $Co_2B$; and with titanium-based alloy the boride may be titanium diboride.

Boriding to achieve the desired diffusion layer may be achieved by any suitable, conventional practice. Specifically, one example of a boriding practice suitable for use in the practice of the invention with iron, nickel, and cobalt base alloys is that disclosed in Fichtl et al, U.S. Pat. No. 3,936,327, issued Feb. 3, 1976. A practice suitable for boriding titanium-base alloys may be that of Kunst, U.S. Pat. No. 3,787,245, issued Jan. 22, 1974.

The deposited coating may be produced by chemical vapor deposition. Other suitable practices such as physical vapor deposition, thermal spraying and the like may also be employed with the alloy substrates of the article of the invention.

In accordance with the invention, when the articles thereof are subjected to thermal cycling, the diffusion layer because of its coefficient of thermal expansion being relatively close to that of the coating, spalling of the coating characterizing prior-art articles of the type is avoided. In addition, with the article in accordance with the invention wherein the substrate is of a titanium-based alloy, during chemical vapor deposition of titanium diboride coatings in thicknesses sufficient for typical end use applications, the hydrogen chloride gas produced during the chemical vapor deposition process is shielded from the titanium-base alloy substrate by the diffused layer of the intermetallic titanium boride compound, e.g. titanium diboride.

It may be seen that this invention for the first time provides a coated article of an iron, nickel and cobalt-base alloy and a practice for manufacturing the same wherein a media resistant coating, such as a coating having wear and/or corrosion resistant properties superior to those of the coated substrate, may be provided in thicknesses suitable for desired end use applications without the disadvantage of spalling during thermal cycling. In the case of titanium-base alloy coated articles, the desired coating of titanium diboride may likewise be provided in adequate thicknesses without degradation of the properties of the titanium-base alloy substrate during depositing of this coating.

It is understood that the terms "alloys" and "metals" are used interchangeably herein and a metal is intended to include as well the alloys thereof.

EXAMPLE I

A sample of AISI Type 01 tool steel having a diffusion layer of iron boride ($Fe_2B$) with a thickness of approximately 0.006 inch was coated by depositing titanium diboride by chemical vapor deposition to achieve a coating thickness of 0.001 inch. Chemical vapor deposition of the coating was performed at a temperature of 900° C. for one hour in accordance with the practice described in "The Coating of Metals with Titanium Diboride by Chemical Vapor Deposition" H. O. Pierson and Erik Randich, Proceedings of Sixth International Conference on Vapor Deposition, 1977, Electrochemical Society, Princeton, N.J., pages 304–317. Examination of the sample after coating revealed that the surfaces exposed to chemical vapor deposition exhibited a continuous and coherent coating of titanium diboride. The coated sample was struck repeatedly with a ball peen hammer without causing removal of the coating.

EXAMPLE II

A sample of the titanium-base alloy composition in weight percent 6% aluminum, 4% vanadium and balance titanium having a diffusion layer of titanium diboride with a thickness of approximately 0.0001 inch was coated by depositing by chemical vapor deposition titanium diboride over the diffusion layer of titanium diboride to achieve a coating thickness of 0.001 inch. The coating by chemical vapor deposition was performed by the same practice as used in Example I. Examination of sample after coating revealed that the surface exposed to chemical vapor deposition exhibited a continuous and coherent coating of titanium diboride. The coated sample was struck repeatedly with a ball peen hammer without causing removal of the coating. A similar sample of the same titanium-base alloy composition but not having a diffusion layer of titanium diboride was coated by chemical vapor deposition in the same manner as the first sample. Upon completion of coating, the sample exhibited significant areas of surface corrosion.

As may be seen from the foregoing description and examples, the invention provides for the production of coated articles of iron, nickel and cobalt-base alloys that may be coated with wear and/or corrosion resistant materials at commercially useful thicknesses heretofore unattainable without spalling. Prior to this invention, if article substrates of the alloy compositions in accordance with the invention were coated with these resistant coatings, and specifically coatings that are hard and wear resistant, such as ceramics and refractories, in thickness required for conventional wear-resistant applications, such coating could not be maintained without spalling during thermal cycling or the application of mechanical stresses. Consequently, prior to this invention, coated articles of this type having a combination of a hard, wear-resistant coating and coating adherence during thermal cycling could not be obtained. In addition, the invention achieves a titanium-base alloy article that may be coated with titanium diboride by chemical vapor deposition without adversely affecting the properties of the titanium-base alloy. Because of the boride diffusion layer acting as a shield, the titanium-base alloy is unaffected by halogens, and specifically chlorine, that are present in compounds, specifically hydrogen chloride, produced incident to the chemical vapor deposition practice. By the use of chemical vapor deposition to deposit the titanium diboride coating, high temperatures detrimental to the titanium-base alloy may be avoided. Consequently, for the first time with this invention required coating thickness for wear resistance may be achieved in combination with maintenance of the desired properties of the titanium-base alloy of the article substrate. By the titanium-base alloy being shielded from the hydrogen chloride produced during chemical vapor deposition of the titanium diboride coating, this low-temperature practice may be used to produce the desired coating thicknesses at temperatures sufficiently low that the titanium-base alloy is not detrimentally temperature affected.

I claim:

1. A coated article comprising an alloy substrate of an alloy selected from the group consisting of iron, nickel, cobalt and titanium base alloys, a diffusion layer formed thereon comprising an intermetallic boride of the substrate alloy, a coating on said layer of a material selected from the group consisting of refractory, ceramic and intermetallic compounds having desired wear and/or corrosion resistent properties superior to those of said alloy substrate.

2. The article of claim 1 wherein said coating has a coefficient of thermal expansion that is closer to that of said diffusion layer than that of said substrate.

3. The article of claim 1 wherein said coating has a coefficient of thermal expansion within +/−30% of that of said diffusion layer.

4. The article of claim 1 wherein said coating has a coefficient of thermal expansion within +/−15% of that of said diffusion layer.

5. The article of claim 1 wherein said coating is a material selected from the group consisting of $TiB_2$, $Al_2O_3$, TiC, $Cr_3C_2$, VC and TiN.

6. The article of claim 1 wherein said coating is $TiB_2$.

7. A coated article comprising an alloy substrate of an iron-base alloy, a diffusion layer formed thereon comprising an intermetallic boride of the substrate alloy, a coating on said layer of a material selected from the group consisting of refractory, ceramic and intermetallic compounds having desired wear and/or corrosion resistant properties superior to those of said alloy substrate.

8. The article of claim 7 wherein said coating has a coefficient of thermal expansion that is closer to that of said diffusion layer than that of said substrate.

9. The article of claim 7 where said coating has a coefficient of thermal expansion within +/−30% of that of said diffusion layer.

10. The article of claim 7 wherein said coating has a coefficient of thermal expansion within +/−15% of that of said diffusion layer.

11. The article of claim 7 wherein coating is a material selected from the group consisting of $TiB_2$, $Al_2O_3$, TiC, $Cr_3$, $C_2$, VC and TiN.

12. The coated article of claim 7 wherein said coating is $TiB_2$.

13. A coated article comprising an alloy substrate of a nickel-base alloy, a diffusion layer formed thereon comprising an intermetallic boride of the substrate alloy, a coating on said layer of a material selected from the group consisting of refractory, ceramic and intermetallic compounds having desired wear and/or corrosion resistant properties superior to those of said alloy substrate.

14. The article of claim 13 wherein said coating has a coefficient of thermal expansion that is closer to that of said diffusion layer than that of said substrate.

15. The article of claim 13 wherein said coating has a coefficient of thermal expansion within +/−30% of that of said diffusion layer.

16. The article of claim 13 wherein said coating has a coefficient of thermal expansion within +/−15% of that of said diffusion layer.

17. The article of claim 13 wherein said coating is a material selected from the group consisting of $TiB_2$, $Al_2O_3$, Tic, $Cr_3C_2$, VC and TiN.

18. The article of claim 13 wherein said coating is $TiB_2$.

19. A coated article comprising an alloy substrate of a cobalt-base alloy, a diffusion layer formed thereon comprising an intermetallic boride of the substrate alloy; a coating on said layer of a material selected from the group consisting of refractory, ceramic and intermetallic compounds having desired wear and/or corrosion resistant properties superior to those of said alloy substrate.

20. The article of claim 19 wherein said coating has a coefficient of thermal expansion that is closer to that of said diffusion layer than that of said substrate.

21. The article of claim 19 wherein said coating has a coefficient of thermal expansion within +/−30% of that of said diffusion layer.

22. The article of claim 19 wherein said coating has a coefficient of thermal expansion within +/−15% of that of said diffusion layer.

23. The article of claims 19 wherein said coating is a material selected from the group consisting of $TiB_2$, $Al_2O_3$, TiC, $Cr_3C_2$, VC and TiN.

24. The article of claim 19 wherein said coating is $TiB_2$.

25. A coated article comprising a titanimum base alloy substrate, a diffusion layer formed thereon comprising an intermetallic titanium boride compound, a coating on said layer of a material selected from the group consisting of refractory, ceramic and intermetallic compounds having desired errosion and abrasion-resistant properties superior to those of said substrate.

26. The article of claim 25 wherein said coating is $TiB_2$.

27. The article of claim 25 wherein said coating is thicker than said diffusion layer.

* * * * *